United States Patent [19]

Richer

[11] Patent Number: 4,955,665

[45] Date of Patent: Sep. 11, 1990

[54] RETRACTABLE SEAT COVER

[76] Inventor: Steven P. Richer, 417, Third Street E., Cornwall, Ont., Canada

[21] Appl. No.: 439,806

[22] Filed: Nov. 21, 1989

[51] Int. Cl.[5] ..... A47C 1/00

[52] U.S. Cl. ..... 297/4; 160/84.1; 5/417

[58] Field of Search ..... 297/4; 5/465, 414; 160/84.1

[56] References Cited

U.S. PATENT DOCUMENTS

| | | | |
|---|---|---|---|
| 2,664,939 | 1/1954 | Besch | 297/4 |
| 2,736,030 | 2/1956 | Moody | 297/4 X |
| 2,829,386 | 4/1958 | Peer | 297/4 X |
| 3,185,362 | 5/1965 | Wakefield | 297/4 X |
| 4,025,105 | 5/1977 | Pekala | 297/4 |
| 4,758,042 | 7/1988 | Liu | 160/84.1 X |
| 4,868,940 | 9/1989 | Masadi | 5/417 |
| 4,880,044 | 11/1989 | Judkins | 160/84.1 |

*Primary Examiner*—Peter A. Aschenbrenner
*Attorney, Agent, or Firm*—Richard J. Hicks

[57] ABSTRACT

An automatically retractable seat cover for use by skiers and sports fans who use cold and/or wet seats is described. A plurality of foam pads are enclosed in a flexible cover and are freely interconnected by at least one elastic cord passing through opposed faces thereof which hold the pads in juxtaposition in a closed position at the user's waist and which can be extended by pulling the lowermost pad downwardly so that the pads form a lay flat seat upon which the user can sit, with his own weight holding the seat and cords in the extended position. Upon standing the cords automatically retract the seat to the folded position.

7 Claims, 2 Drawing Sheets

RETRACTABLE SEAT COVER

FIELD OF INVENTION

This invention relates to a seat covering device for use by skiers, sports fans and the like. More particularly this invention relates to a seat covering device which can be worn by the user in a retracted position and simply extended for use.

BACKGROUND OF INVENTION

A common cause of discomfort to skiers who use a chair lift or sports fans who sit for relatively long periods in an ice rink or other stadium, is the coldness and hardness of the seats.

Carrying a cushion or even a drying cloth is generally not practical due to the bulk thereof and/or lack of a pocket in which to stow the cushion or cloth when not in use. U.S. Pat. No. 4,689,829 discloses a seat covering device which is simply a cloth flap which can be supported, at one end, around the waist of a skier and let down over the skier's rear when sitting on a ski chair lift. After use the flap is rolled up and secured by a pair of loops adjacent the waist strap. Such a device is easy to let down and use but is difficult or awkward to return to the rolled up position.

Canadian Patent No. 1,235,551 also teaches a skier's seat covering device comprising a plurality of pad members having a flexible connection therebetween with a pair of straps at one end thereof to tie the device around the user's waist and a pair of straps at the other end thereof to tie around the legs when in the extended position and around the waist when in the retracted position. Here again, gravity will allow easy extension but retraction is tedious, awkward and time consuming.

There is, therefore, a need for a seat covering device which can be worn around a user's waist, easily extended and which retracts quickly and easily to the stored position, preferably automatically, and which does not detract from the user's, and particularly a skier's, appearance.

OBJECT OF THE INVENTION

It is, therefore, an object of the present invention to provide an improvement over the prior art devices, in that the seat covering device of the present invention can be extended readily yet retracts automatically to a neat compact stored position around the user's waist.

SUMMARY OF INVENTION

Thus, by one aspect of the present invention there is provided a seal covering device comprising:

(a) a plurality of pad members each comprising a layer of flexible insulating material;

(b) a cover for encasing said pad members and providing a flexible connection forming a fold area between adjacent pad members permitting adjacent ones of said pad members to be placed in juxtaposition with each other to form a folded article and, when unfolded about said fold area, a lay-flat article having first and second longitudinal ends; and (c) at least one elastic cord member secured at one end thereof to a pad member at a said first end of said lay flat article and at the other end thereof to a pad member at said second end of said lay flat article; said cord member extending freely through alternate opposed sides of each of said adjacent pad members intermediate the pad members at said first and second ends, whereby said pad members may be extended, against tension in said cord member to form said lay flat article and retract automatically to form said folded article upon release of said tension.

DETAILED DESCRIPTION OF THE PREFERRED EMBODIMENT

Figure 1:
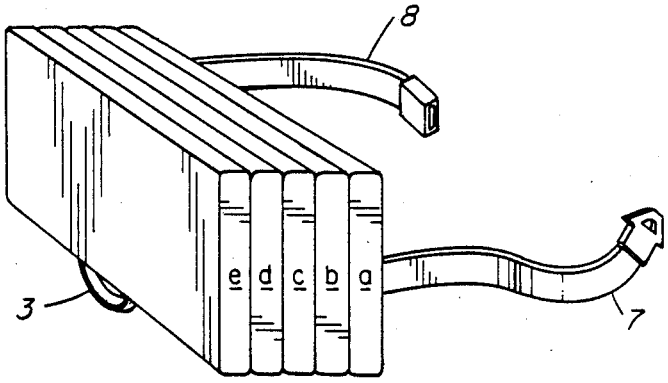
FIG. 1 is a sketch of the device of the present invention in the retracted or closed position.
Figure 2:
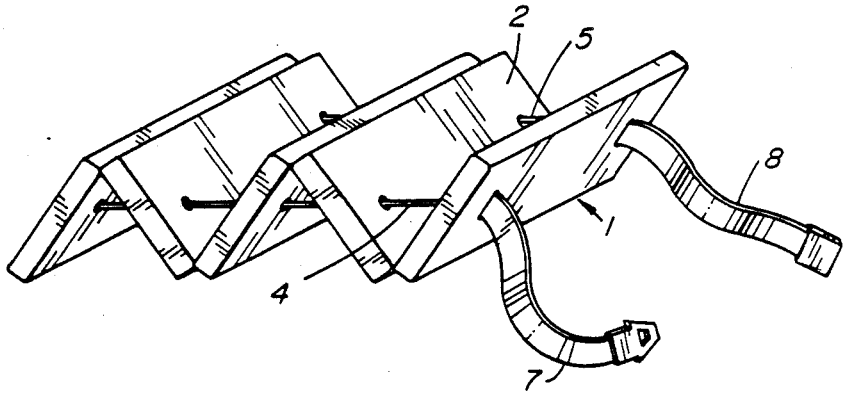
FIG. 2 is a sketch of the device of the present invention in an intermediate position.
Figure 3:
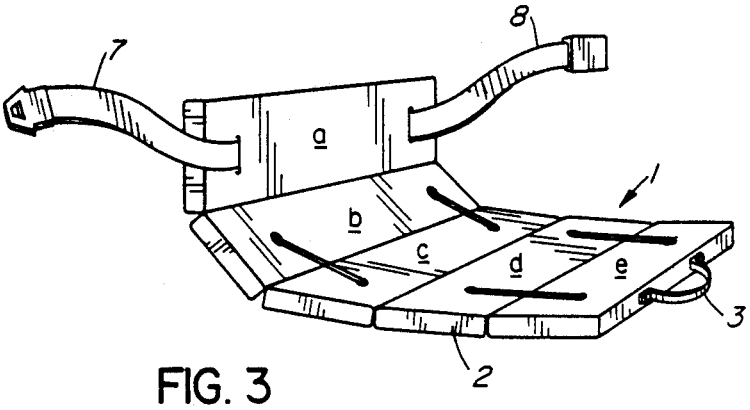
FIG. 3 is a sketch of the device of the present invention in the extended or open position.
Figure 4:
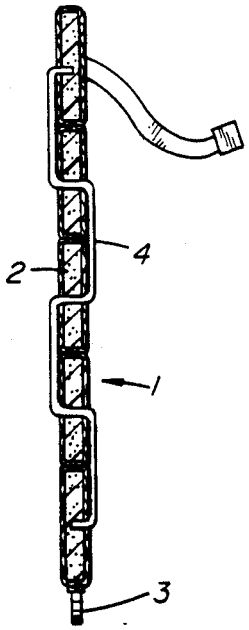
FIG. 4 is a side view of the device of FIG. 3.

Referring now to FIGS. 1–4, there is shown a seat cover device comprising a plurality generally but not necessarily five in number, of flexible heat insulating substantially rectangular pad members 1*a*, 1*b*, 1*c*, 1*d*, and 1*e* contained within a continuous cloth cover 2. Preferably pads 1 are made of a closed cell polyurethane foam such as that sold under the trademark "Ensolite" and are each about ⅜"–½" thick and about 12" wide by 3" long. The cover 2 is generally nylon, such as rip stop nylon, and is sewn into a series of individual pockets each containing one of the pads 1, and forming a flexible connection or fold area between adjacent pads, permitting adjacent ones of the pads to be placed in juxtaposition with each other to form a layered or folded article as shown in FIG. 1 and, when unfolded to form a lay-flat article as shown in FIG. 3. Preferably a loop 3 is secured centrally along the lower edge of the bottom edge of the bottom pad to facilitate a downward pull by the user to extend the device from the closed or retracted position of FIG. 1 to the extended or open position of FIG. 3. As seen more clearly in FIG. 2 there is also provided a pair of elastic cord members 4, 5 each of which is firmly secured at one end thereof to the middle of one face of the top pad 1*a* and at the other end thereof to the middle of one face of the lowermost pad 1*e*. Each of cords 4 and 5 passes alternately through the opposed faces of the intermediate pads 1*b*, 1*c*, and 1*d*. Cords 4, 5 are relatively short so that upon release of the tension thereon they will retract and draw the pads 1*a*–1*e* into the closed position shown in FIG. 1 and there retain them in a compact and tight formation.

Figure 5:
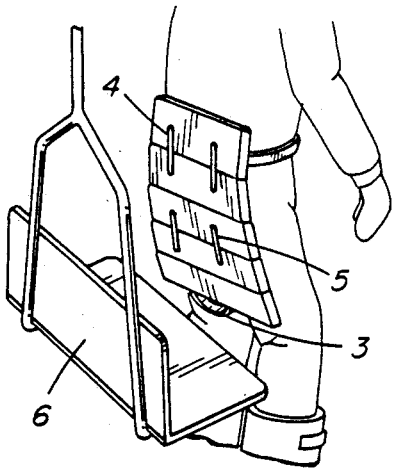
FIG. 5 is a sketch of the device of the present invention in use by a skier.
Figure 6:
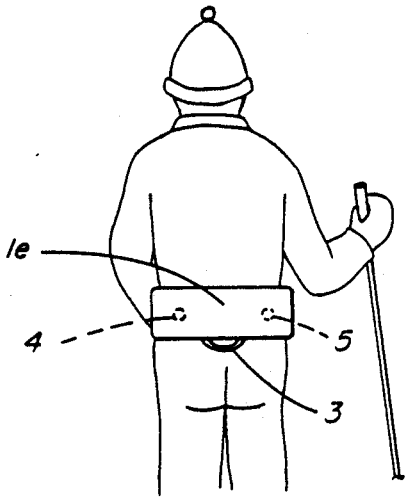
FIG. 6 is a sketch of the device of the present invention in the retracted position as worn by a skier.

Thus, in use, for example by a skier, the user who is wearing the device around his waist secured by straps 7, 8 reaches behind himself, grasps loop 3, which is preferably but not essentially also elastic, and pulls it smartly downwards so as to extend the pads against the tension in elastic cords 4, 5 to the extended position as shown in FIG. 5 as he seats himself on the chair 6. The user's weight holds the extended cover firmly in position between the chair and his rear end. Upon reaching the unloading point, the skier simply stands up and skis away in the usual manner and as soon as his weight is taken off the extended seat it snaps back into the retracted position under the action of the elastic cords 4, 5 as shown in FIG. 6. There is no need for the skier to remove his gloves to manually roll up his seat cover as with the prior art.

It will be appreciated that while this invention has been described with particular reference to use by a skier, the invention is equally useful to all manner of sports fans and others who sit on relatively hard and/or cold seats such as are common in ice rinks, football stadiums, ice fishing huts and the like. Further modifications may be made to the device without departing from the scope of the invention. For example, straps 7, 8 may be secured to each other by buckles or by "Velcro" (TM) strips, and the seat cover may be silk screened to incorporate team logos or other advertising matter. Similarly, while reference has been made specifically to the use of two separate parallel elastic cords it will be appreciated that a single cord could be used or even more preferred a single cord could be looped through one end pad and the two free ends thereof secured to the other end pad.

I claim:

1. A seat covering device comprising:

(a) a plurality of pad members each comprising a layer of flexible insulating material;

(b) a cover for encasing said pad members and providing a flexible connection forming a fold area between adjacent pad members permitting adjacent ones of said pad members to be placed in juxtaposition with each other to form a folded article and, when unfolded about said fold area, a lay-flat article having first and second longitudinal ends; and (c) at least one elastic cord member secured at one end thereof to a pad member at a said first end of said lay flat article and at the other end thereof to a pad member at said second end of said lay flat article; said cord member extending freely through alternate opposed sides of each of said adjacent pad members intermediate the pad members at said first and second ends, whereby said pad members may be extended, against tension in said cord member to form said lay flat article and retract automatically to form said folded article upon release of said tension.

2. A seal covering device as claimed in claim 1 including strap means, adjacent said first end, adapted to encircle a wearer's torso so as to secure said seat device to said wearer.

3. A seat covering device as claimed in claim 2 including loop means at said second end arranged so as to facilitate extension of said device from said folded article to said lay flat article.

4. A seat covering device as claimed in claim 2 wherein said flexible insulating material comprises a closed cell urethane foam.

5. A seat covering device as claimed in claim 4 wherein said pads are substantially rectangular in shape.

6. A seal covering device as claimed in claim 1 including a pair of parallel spaced apart elastic cords.

7. A seat covering device as claimed in claim 1 wherein said one elastic cord member is looped through said pad member at said first end and both ends thereof are secured to said pad member at said second end of said lay flat article.

* * * * *